United States Patent [19]

Tudek

[11] Patent Number: 4,461,476

[45] Date of Patent: Jul. 24, 1984

[54] BILLIARD TABLE WITH CENTER HOLE AND SLIDING POCKET DOORS FOR VARIOUS GAMES OF BILLIARDS, GOLF AND THE LIKE

[76] Inventor: Arthur L. Tudek, 507 Indiana Ave., Glassport, Pa. 15045

[21] Appl. No.: 247,239

[22] Filed: Sep. 18, 1981

[51] Int. Cl.[3] ..... A63D 15/00

[52] U.S. Cl. ..... 273/3 R; 273/3 A; 273/4 R

[58] Field of Search ..... 273/3 R, 3 A, 4 A, 4 R, 273/12, 23, 85 R, 129 M, 126 R, 126 A, 23, 11 R; D21/14, 10, 20

[56] References Cited

U.S. PATENT DOCUMENTS

| | | | |
|---|---|---|---|
| 81,759 | 8/1830 | Salter et al. | 273/3 A |
| 296,677 | 4/1884 | Chasley | 273/3 A |
| 322,436 | 7/1885 | Ganser | 273/4 R |
| 409,060 | 8/1889 | Paine | 273/11 R |
| 688,027 | 12/1901 | Moyer | 273/3 A |
| 831,328 | 9/1906 | DeCastro | 273/4 R |
| 855,684 | 6/1907 | Williamson | 273/23 |
| 1,845,531 | 2/1932 | Terry | 273/3 A |
| 3,029,078 | 4/1962 | Frigo | 273/3 A |
| 3,220,730 | 11/1965 | Fine | 273/129 M |
| 3,428,322 | 2/1969 | Motz | 273/3 A |
| 3,947,035 | 3/1976 | Buchard | 273/126 R |
| 4,017,079 | 4/1977 | Appelaniz | 273/126 R |
| 4,318,543 | 3/1982 | Vollendorf | 273/4 A |

FOREIGN PATENT DOCUMENTS

| | | | |
|---|---|---|---|
| 50431 | 2/1931 | Australia | 273/3 A |
| 66742 | 1/1893 | Fed. Rep. of Germany | 273/4 R |
| 66932 | 2/1893 | Fed. Rep. of Germany | 273/4 A |
| 1422335 | 11/1965 | France | 273/121 A |
| 1402433 | 8/1975 | United Kingdom | 273/3 A |

*Primary Examiner*—Richard J. Johnson
*Assistant Examiner*—William H. Honaker
*Attorney, Agent, or Firm*—William J. Ruano

[57] ABSTRACT

A generally rectangular billiard table with a circular hole slightly larger than a billiard ball at the exact center and through the bed of the table. The physical cut-out of the hole is utilized as a plug for the center hole when needed and is covered with the same material as that of the bed and rails. The other 6 holes and the center hole are provided with sliding horizontal trap doors located at the underside of the bed. These additions and other innovations provide many games of amusement and skill of billiards, golf and the like. With the installation or removal of some accessory equipment, this table converts into a pocket, carom, bumper and golf billiard table.

4 Claims, 13 Drawing Figures

BILLIARD TABLE WITH CENTER HOLE AND SLIDING POCKET DOORS FOR VARIOUS GAMES OF BILLIARDS, GOLF AND THE LIKE

BRIEF SUMMARY OF THE INVENTION

This invention relates to generally rectangular billiard table with a circular hole in the exact center and through the bed of the table. When the center hole sliding door, that is located at the underside of the bed, is in a open position, a ball that rolls into the hole will fall through into a ball return tube and roll to the head of the table. When the center hole sliding door is in a close position, a ball that rolls into it will stop and rest in the hole at the depth of the thickness of the bed. Also when this sliding door is closed, a bumper can be screwed into the sliding door, thus giving the table a stable center bumper. Whenever the sliding door that service the six other conventional pockets are in an open position, the balls that fall into them will go into a ball return and return to the head of the table. When these six sliding doors are closed and balls roll into them (three to a pocket is maximum) they will also rest near the surface, sunk to the depth of the bed. When the sliding doors are still in the closed position, right angled, felt covered, rubber rails that are the size of the corner pocket openings that are attached to a circular plate, which is the exact thickness of the bed of the table are placed in the openings of the corner pockets to block them and act as a continuous rail as a carom table. The side pockets are done in the same manner except the plugs are straight line rubber rail. While all of the sliding doors except the center door is opened, the center plug, which is the cut-out of the center hole, and is felt covered and has the thickness of the bed, is placed in the center opening to plug it thus giving the table a regular pocket billiard table mode.

CROSS REFERENCE TO PRIOR ART

While it has, of course, been common for centuries for people to play pocket and carom billiards on separate and specific tables, also snooker, and now as of late such games as bumper and rebound pool. None is known to combine all these games and others that can be played with the skill and accuracy as the individual table than this singular table.

SUMMARY OF THE INVENTION

The principal object of this present invention is to provide generally rectangular billiard table with a circular hole slightly larger than a billiard ball, located at the exact center of table to open avenues for different games of amusement and skill.

Another object is the provision of generally rectangular pool table with a circular hole in the center, with a tubular pipe attached underside to return holed balls back to the head of the table, thus the game of 7 pocket billiards can be played. With the center plug inserted, a regular game of pocket billiards can be played.

A further object is to provide a rectangular billiard table with a circular hole in the center and sliding horizontal trap doors at each of the 7 openings thus with all of the doors closed, the game of "Keno" can be played.

Still another object is to provide a rectangular pool table with a circular center hole and the sliding center hole in the closed position to receive a bumper that is screwed down into the door, thus the various games of bumper and rebound pool can be played.

Still another object is to provide a rectangular pool table with a circular center hole and seven sliding doors in closed position to receive 4 right angle rubber rails adhered to a plate that is the thickness of the bed, and placed at the corner openings. Two straight line rubber rails adhered to a plate, and placed in the side openings and the center plug affixed, the game of carom billiards can be played. With the center plug removed in this mode, it opens doors for other games to be played, such as "King of the Hill".

A still further object is to provide a rectangular billiard table with a circular center hole and seven sliding trap doors and all in the closed position except the center one. Thus a game of golf can be played by utilizing standard golf balls and a specially designed putter. The putter base is made of a transparent material as to see through it. This transparent putter base is attached to cue stick permanently to resemble a mechanical bridge in billiards. This putter is multi-purpose. Firstly, it is used as a putter for playing golf pool. Secondly, when a cue tip assembly is screwed into the face of the transparent base, it is used as sliding, shooting cue stick, ideal for handicap persons and children to reach shots without the use of a mechanical bridge. Thirdly, it also can be used as a regular mechanical bridge for all billiard games.

These and other objects and advantages will be apparent as the specifications are considered with the accompanying drawings wherein.

FIG. 1 is a top view of a rectangular billiard table showing the center circular hole, the four corner pockets, the two side pockets and the tubular ball return. At the sides of the drawing are the accessories shown in magnified views. Side drawing 4, 5, 6 are enlarged top views of the three different plugs and denote where they are to be placed. Side enlarged drawings 4A, 5A and 6A are shown in their front or side view.

DETAILED DESCRIPTION

Figure 1:
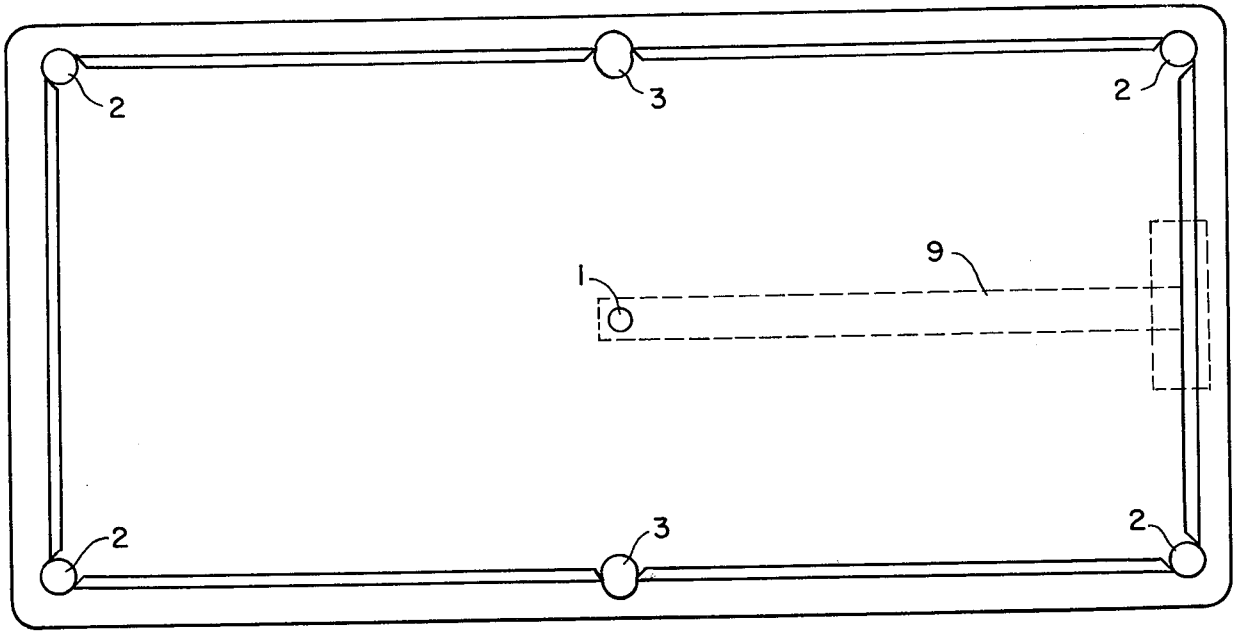
Figure 5:
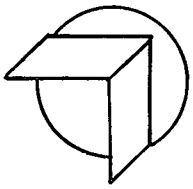
Figure 5A:
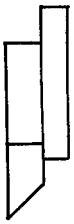
Figure 4A:
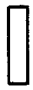
Figure 4:
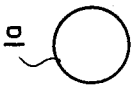

Referring more particularly to the drawings in FIG. 1 Numerical 1 identifies the center hole. Center plug 4 (magnified) can be placed into 1. Right angle rubber rail assembly 5 can be placed into 2, the corner openings. Straight angle rubber rail assembly 6 can be placed into 3, the side opening. Bumper 7 can be screwed into 1 when the sliding trap door 11 (shown in FIG. 2) is closed. The tubular ball return 9 will be shown in FIG. 2.

Figure 2:
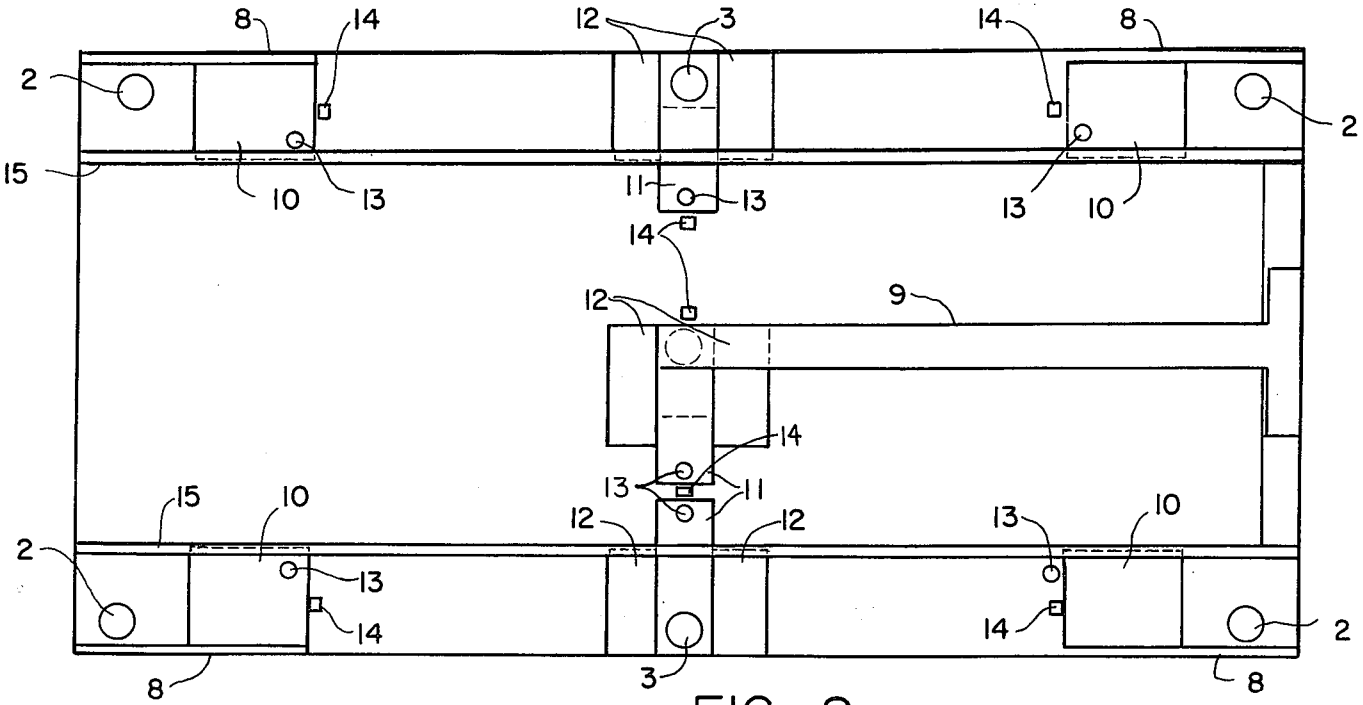
FIG. 2 is a underside view of the table with the two side panels that act as the ball returns are removed to simplify the drawing.
Figure 6A:
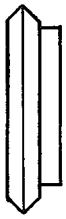
Figure 6:
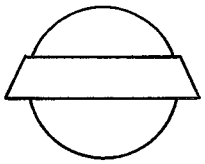
Figure 2A:
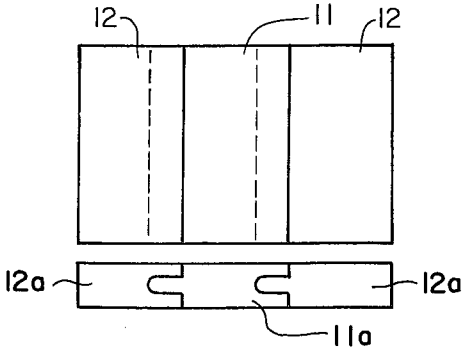
FIG. 2A is an enlargement of the side and top view of the sides and center sliding trap doors.
Figure 9:
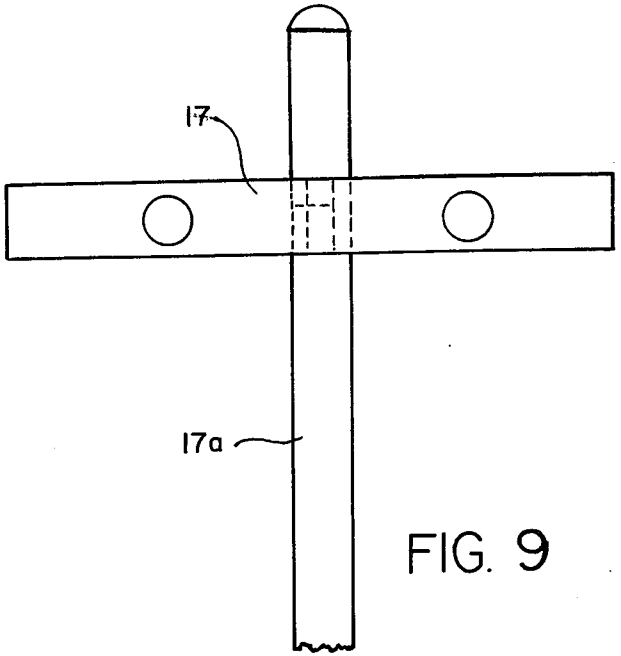
Figure 8:
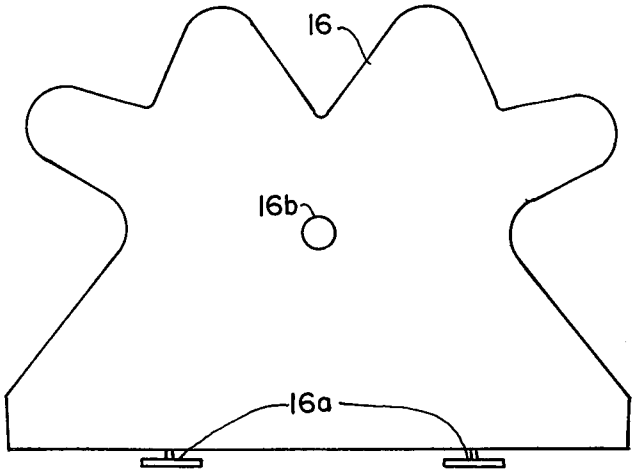
Figure 7:
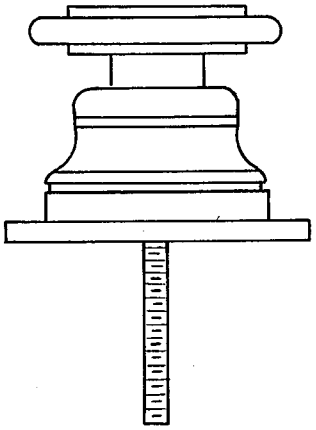

As best shown in FIG. 2 where 1, 2 and 3 were described in previous paragraph. Corner slide door tracks 8 holds the corner sliding trap doors in place on one side. Tubulr ball return 9 which receives the center hole's ball, when the door is open and return it to the head of the table. Corner sliding doors 10 rests and slide on outside track 8 and steel angular rail 15. Side and center sliding doors 11 are shown fitting into permanently attached tongue-groove assembly 12. A side view of FIG. 2A depicts this, 11A and 12A. Grip handles 13 for all the sliding doors are shown in relative position on the sliding doors 10 & 11. Door stoppers 14 for all the sliding doors are shown in relative position to the sliding doors 10 & 11. Steel angular rails 15 which run the entire length of table has three purposes: a. to stabilize the bed. b. to act as the inside track for the corner sliding doors 10. c. to receive the end panels that also run the entire length of table at both sides and act as the ball returns.

Figure 3:
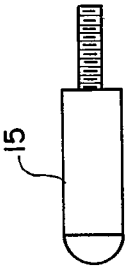
FIG. 3 are the views of the putter-sliding cue-bridge.

As shown in FIG. 3, transparent putter base 16 is shown with the metal guides 16A in which the cue tip assembly 15 can be screwed into the hole of putter base face **16*b* and protruding into the putter cue stick 17A. FIG. 3, 17 illustrates the bottom view of the sliding, shooting cue stick. Then the cue tip assembly 15** is unscrewed, it can be used as the golf putter for the golf pool game or can be used as regular mechanical bridge as used in all billiard games.

While a preferred embodiment of a rectangular billiard table with a circular hole in the center and horizontal sliding trap doors on the underside of the bed and the accessory equipment herein shown and described, it is to be understood that various changes and improvements may be made therein without departing from the scope and spirit of the appended claims.

What is claimed is:

1. In combination with a rectangular pocket billiard table having six pockets, one at each of the four corners and two at opposite sides of the longitudinal center, each of the pockets having a hole communicating with a return means for leading the dropped ball to the head of the table; the improvement comprising a central hole slightly larger than a billiard ball in said table having underneath said central hole, a return tube leading to the head of the table, a plug to selectively plug said central hole, a sliding trap door underneath each of said six holes, and underneath said central hole, to selectively convert the pocket billiard table to a six or seven hole pocket billiard table wherein each of the pockets is selectively in or out of communication with the ball return means.

2. A billiard table as recited in claim 1 together with a disc shaped plug for plugging the tops of each of said six holes along the sides and corners of the billiard table, the corner plugs having right angular frames and the side plugs having straight frames for closing the gap and continuing the frame construction along the inside edge of the billiard table.

3. A billiard table as recited in claim 1 together with a bumper having a depending threaded shank for screw threading into a threaded opening of the sliding door underneath said central opening to provide a stable support.

4. A billiard table as recited in claim 1 together with a transparent bridge base with a cue tip assembly attached at the central front of said base having glides on the bottom permanently secured to a stick for striking balls from any spot on the table and for use as a conventional mechanical bridge as used in billiard games.

* * * * *